US010273651B2

(12) United States Patent
Beckhusen

(10) Patent No.: US 10,273,651 B2
(45) Date of Patent: Apr. 30, 2019

(54) REVERSIBLE FLOW PATH CONSTRUCTION

(71) Applicant: Caterpillar Inc., Peoria, IL (US)

(72) Inventor: Jordan R. Beckhusen, Waco, TX (US)

(73) Assignee: Caterpillar Inc., Deerfield, IL (US)

( * ) Notice: Subject to any disclaimer, the term of this patent is extended or adjusted under 35 U.S.C. 154(b) by 347 days.

(21) Appl. No.: 15/248,992

(22) Filed: Aug. 26, 2016

(65) Prior Publication Data

US 2018/0058043 A1 Mar. 1, 2018

(51) Int. Cl.

| | |
|---|---|
| ***F15B 11/15*** | (2006.01) |
| ***E02F 3/42*** | (2006.01) |
| ***F15B 13/04*** | (2006.01) |
| ***F15B 13/02*** | (2006.01) |
| ***F15B 13/042*** | (2006.01) |
| ***F15B 1/26*** | (2006.01) |
| ***E02F 3/36*** | (2006.01) |
| *E02F 3/34* | (2006.01) |

(52) U.S. Cl.

CPC ..... *E02F 3/422* (2013.01); *E02F 3/3654* (2013.01); *F15B 1/26* (2013.01); *F15B 11/15* (2013.01); *F15B 13/024* (2013.01); *F15B 13/0401* (2013.01); *F15B 13/042* (2013.01); *E02F 3/3414* (2013.01); *F15B 2013/041* (2013.01); *F15B 2211/30525* (2013.01); *F15B 2211/41554* (2013.01)

(58) Field of Classification Search

CPC ..... E02F 3/3654; E02F 3/3663; E02F 3/422; F15B 13/042; F15B 13/024; F15B 13/0401; F15B 11/15; F15B 1/26

See application file for complete search history.

(56) References Cited

U.S. PATENT DOCUMENTS

| | | | | |
|---|---|---|---|---|
| 6,431,049 | B1 * | 8/2002 | Berg | E02F 3/3663 137/596.2 |
| 6,773,223 | B2 * | 8/2004 | Harris | E02F 3/3636 37/468 |
| 7,017,674 | B2 * | 3/2006 | Bell | E02F 9/2025 172/2 |
| 7,866,149 | B2 * | 1/2011 | Brinkman | E02F 9/221 60/378 |
| 8,051,651 | B2 * | 11/2011 | Cochran | E02F 9/2239 60/428 |

FOREIGN PATENT DOCUMENTS

| | | |
|---|---|---|
| CN | 202577113 U | 12/2012 |
| CN | 204080597 U | 1/2015 |
| CN | 104329299 A | 2/2015 |
| CN | 204239353 U | 4/2015 |

* cited by examiner

*Primary Examiner* — Abiy Teka

(74) *Attorney, Agent, or Firm* — Leydig, Voit & Mayer, Ltd.

(57) ABSTRACT

A flow control manifold that routes pressurized fluid from one of a first fluid manifold connection and a second fluid manifold connection of the flow control manifold to an input of a work tool and directs return fluid from an outlet of the work tool to the other of the first and second fluid manifold connections not receiving pressurized fluid.

20 Claims, 6 Drawing Sheets

REVERSIBLE FLOW PATH CONSTRUCTION

TECHNICAL FIELD

This disclosure relates generally to work machines with hydraulically operated work tools.

BACKGROUND

Various work machines such as excavators, backhoes, skid steer loaders, or other like machines can be fitted with a variety of work tools for a broad range of purposes. Work machines can be used in many different applications, including those in the areas of construction, agriculture, landscaping, and mining.

One such work machine is known generically as a "skidsteer." A skidsteer, skid loader, or skidsteer loader, is a small, rigid-frame, engine-powered machine with lift arms and a mounting interface used to receive and attach to a wide variety of labor-saving tools or attachments. Examples of work tools for a skidsteer include augers, backhoes, bale spears, blades, brooms, brush cutters, buckets, cold planers, compactors, forks, hammers, material handling arms, mulchers, rakes, saws, snow blowers, snowplows, snow pushers, stump grinders, tillers, and trenchers. These work tools are typically configured to mount to work machine lift arms or other articulated members of the work machine and connect to one or more hydraulic and/or electrical and/or mechanical system of the work machine.

It is well known that work tools are often not easily adaptable to connect to machines from different manufacturers. For example, some work tools operate based on a specific one-way flow of hydraulic fluid from a machine. Connecting such a work tool improperly may result in damage to the work tool or may cause unsafe operating conditions. Incorrect connection of such a work tool may be possible when there are multiple connections to the machine and multiple inputs and returns on the work tool. Incorrect flow of fluid may be blocked by the work tool with built-in safety features, which may damage or at least render the work tool inoperable. While adapter kits are often available to adapt a work tool to a work machine with a different configuration, the time to identify and procure the appropriate adapter, and also the time and cost to install the adapter, may increase the complexity and cost of operation of the machine.

The disclosed system is directed to overcoming one or more of the problems set forth above and/or other problems of the prior art.

SUMMARY

The present disclosure is generally directed, in one aspect, to a flow control manifold for connecting a work tool to a work machine, including a first fluid manifold connection and a second fluid manifold connection. The first and second fluid manifold connections are in fluid communication with the work machine. An input is configured to supply pressurized fluid from the work machine to the work tool and an outlet is configured to receive return fluid from the work tool. A first passage fluidly connects the first fluid manifold connection to the input and conveys pressurized fluid therethrough. The first passage includes a first check valve that opens in the direction of the input. A second passage fluidly connects the outlet to the second fluid manifold connection and conveys return fluid therethrough, the second passage including a second check valve that opens in the direction of the second fluid manifold connection. A third passage fluidly connects the second fluid manifold connection to the input and conveys pressurized fluid therethrough, the third passage including a directional control valve that opens to permit fluid to flow through the third passage in response to the presence of the pressurized fluid in the third passage and comprising a third check valve that opens in the direction of the input. A fourth passage fluidly connects the outlet to the first fluid manifold connection and conveys return fluid therethrough, the fourth passage including a fourth check valve that opens in the direction of the first fluid manifold connection.

The disclosure also describes, in another aspect, a work machine, including a work tool. A source of fluid pressure operates the work tool. A fluid reservoir stores return fluid from the work tool. A flow control manifold fluidly connects the work tool to the work machine. The flow control manifold includes a first fluid manifold connection and a second fluid manifold connection, the first and second fluid manifold connections in fluid communication with the work machine. An input is configured to supply pressurized fluid from the work machine to the work tool and an outlet is configured to receive return fluid from the work tool. A directional control valve includes a four-way, two-position valve including a first section, a second section, and a pilot port. The pilot port is in fluid communication with the second fluid manifold connection. The directional control valve assumes a first position of the two positions wherein a first section routes fluid pressure from the first fluid manifold connection to the input and routes return fluid from the outlet to the second fluid manifold connection when fluid pressure at the pilot port is relatively lower than at the first fluid manifold connection and the directional control valve assuming a second position of the two positions wherein a second section routes fluid pressure from the second fluid manifold connection to the input and routes return fluid from the outlet to the first fluid manifold connection when fluid pressure at the pilot port is relatively higher than at the first fluid manifold connection.

In yet another aspect, the disclosure describes a method of directing a flow of fluid including a supply of pressurized fluid from a work machine to an input of a work tool and returning the flow of fluid including return fluid to the work machine from an outlet of the work tool through a flow control manifold, including generating, by the work machine, a supply of pressurized fluid. The supply of pressurized fluid is connected to one of a first fluid manifold connection and a second fluid manifold connection of the flow control manifold. A pilot port of a directional flow valve of the flow control manifold is placed in communication with the flow of fluid. A first position of the directional flow valve is produced and maintained when pressure of the fluid in the pilot port is greater than or equal to the pressurized fluid. In the first position, the pressurized fluid is directed from the one of the first fluid manifold connection and the second fluid manifold connection of the flow control manifold to the input. A second position of the directional flow valve is produced and maintained when pressure of the fluid in the pilot port is less than the pressurized fluid. In the second position, the pressurized fluid is directed from the other of the first fluid manifold connection and the second fluid manifold connection of the flow control manifold to the input and the return fluid is directed from an outlet of the work machine to the one of the first and second fluid manifold connections not receiving pressurized fluid.

DETAILED DESCRIPTION

Figure 1:
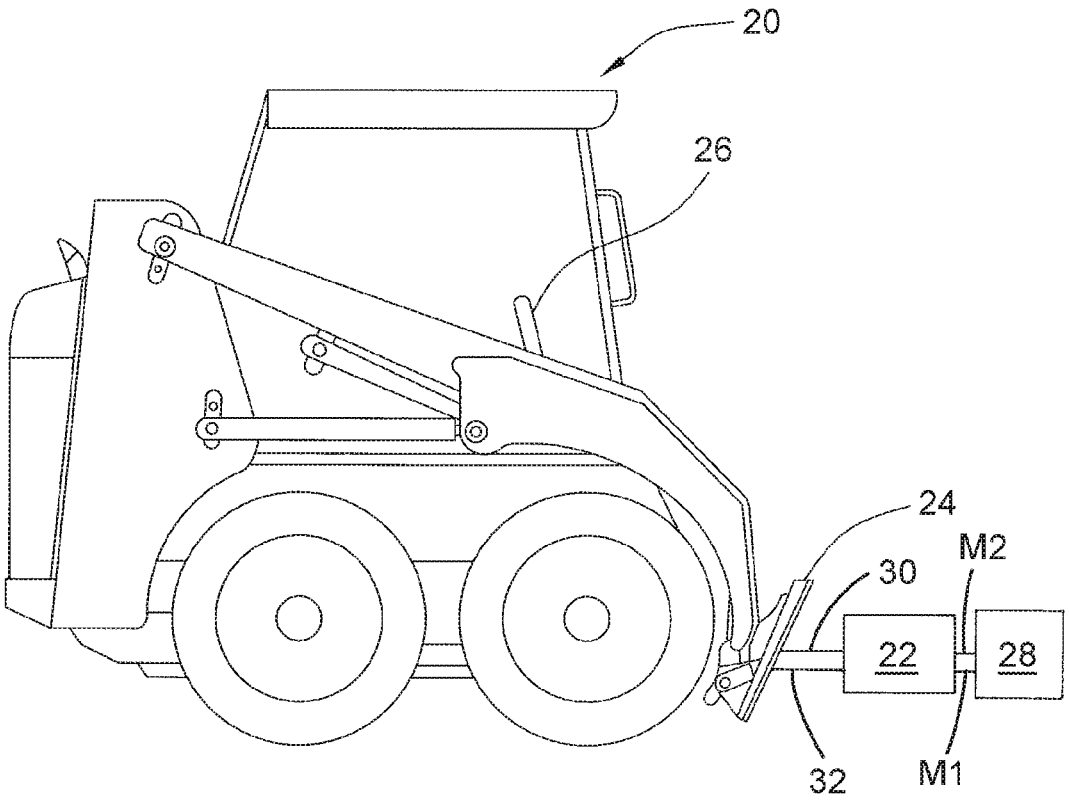
FIG. 1 is a side view of an embodiment of a work machine.

FIG. 1 illustrates a type of work machine 20 known as a skidsteer loader according to an exemplary embodiment of the present disclosure. Although FIG. 1 depicts a skidsteer loader, it will be understood that the present disclosure may be used in conjunction with other work machines known in the art. Such work machines may include, but are not limited to, wheel dozers, wheel loaders, track loaders, backhoe loaders, compactors, forest machines, front shovels, hydraulic excavators, integrated tool carriers, multi-terrain loaders, material handlers, and agricultural tractors.

As illustrated in FIG. 1, a hydraulically operated work tool or work implement 28 may be operatively attached to the front end of the work machine 20. It will be understood that if a work machine 20 is capable of utilizing rear-mounted work tools, such tools may also be operatively attached to the back-end of the work machine 20. The work machine 20 includes a work tool receiver 24 that is configured to accept a variety of work tools 28.

A flow control manifold 22 is interposed between the work machine 20 and the work tool 28. The flow control manifold 22 may be incorporated into the structure of the work tool 28 or may be separate from the work tool. A user input device 26 is used to control operation of the work machine 20 to generate directional inputs to cause the machine to move forward and reverse, to cause the machine to turn right and left, and direct operation of the work tool 28.

In general, work tools 28 may be divided into two categories: those capable of performing a single function or application and those capable of performing more than one function. Such so-called "single-application" work tools 28 may include, but are not limited to, trenching tools, material handling arms, augers, brooms, rakes, stump grinders, snow blowers, wheel saws, de-limbers, tire loaders, and asphalt cutters. Likewise, "multi-application" tools, may include, but are not limited to buckets, angle blades, cold planers, compactors, forks, landscape rakes, grapples, backhoes, hoppers, multi-processors, truss booms, and thumbs. The present disclosure contemplates a work tool 28 operated, at least in part, with hydraulic fluid. The applications capable of being performed by the work tool 28 may include, but are not limited to, stockpiling, trenching, hammering, digging, raking, grading, moving pallets, material handling, snow removal, tilling soil, demolition work, carrying, cutting, backfilling, and sweeping. Work machines 20 that have more flexibility regarding attachment and use of a great number and variety of work tools 28 are especially enhanced by the systems and methods of the present disclosure.

The work machine 20 generates pressurized hydraulic fluid with well-known mechanisms, e.g., a fluid pump (not shown). Pressurized hydraulic fluid is supplied to the flow control manifold 22 with a hydraulic supply line 30 and is returned to the work machine at a lesser hydraulic pressure from the flow control manifold with hydraulic return line 32. Flow control manifold 22 directs pressurized hydraulic fluid to the input M1 of the work tool 28. Fluid is circulated through various actuators in the work tool to perform work, and is returned from the work tool to the flow control manifold via outlet M2 of the work tool. The configuration of the flow control manifold 22 supplies pressurized hydraulic fluid to the work tool 28 via input M1 regardless of how lines 30 and 32 attach to the flow control manifold.

Figure 2:
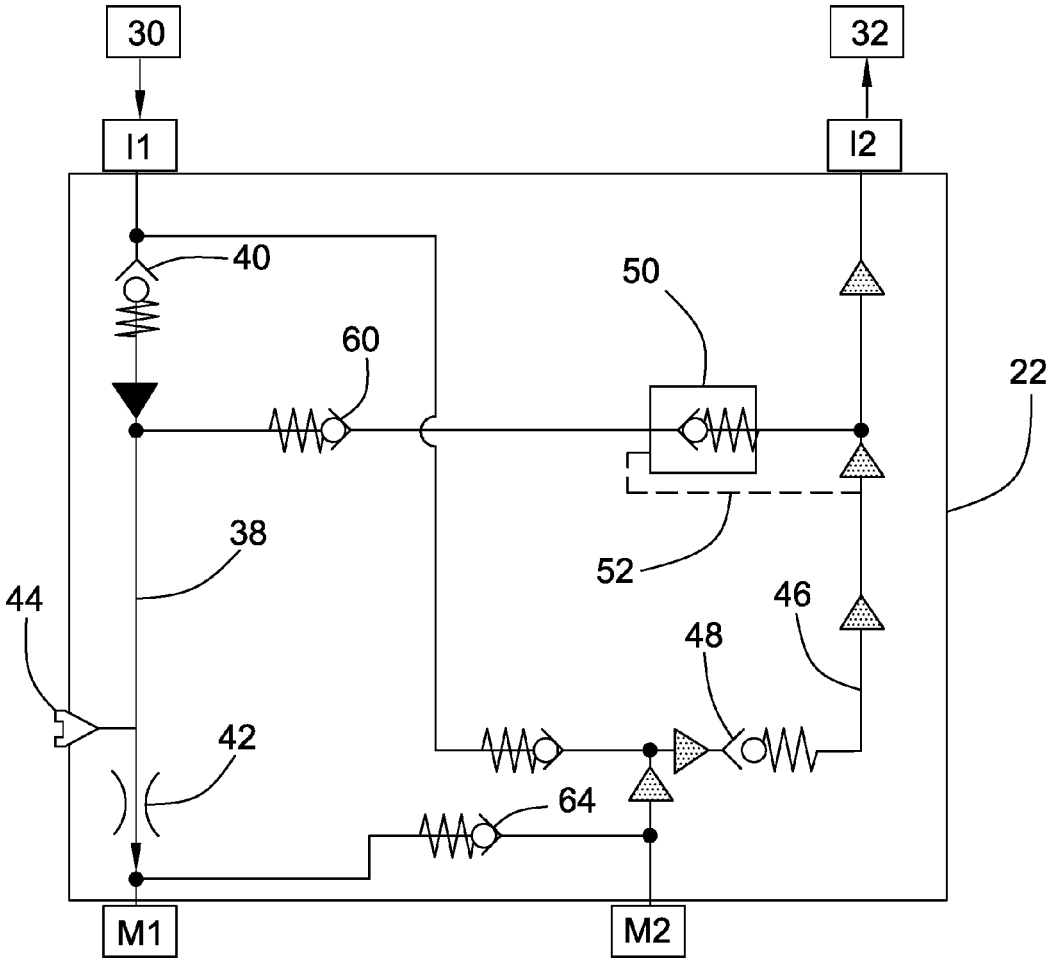
FIG. 2 is a diagram of one embodiment of a flow control manifold connected to the work machine according to a first flow path configuration.
Figure 3:
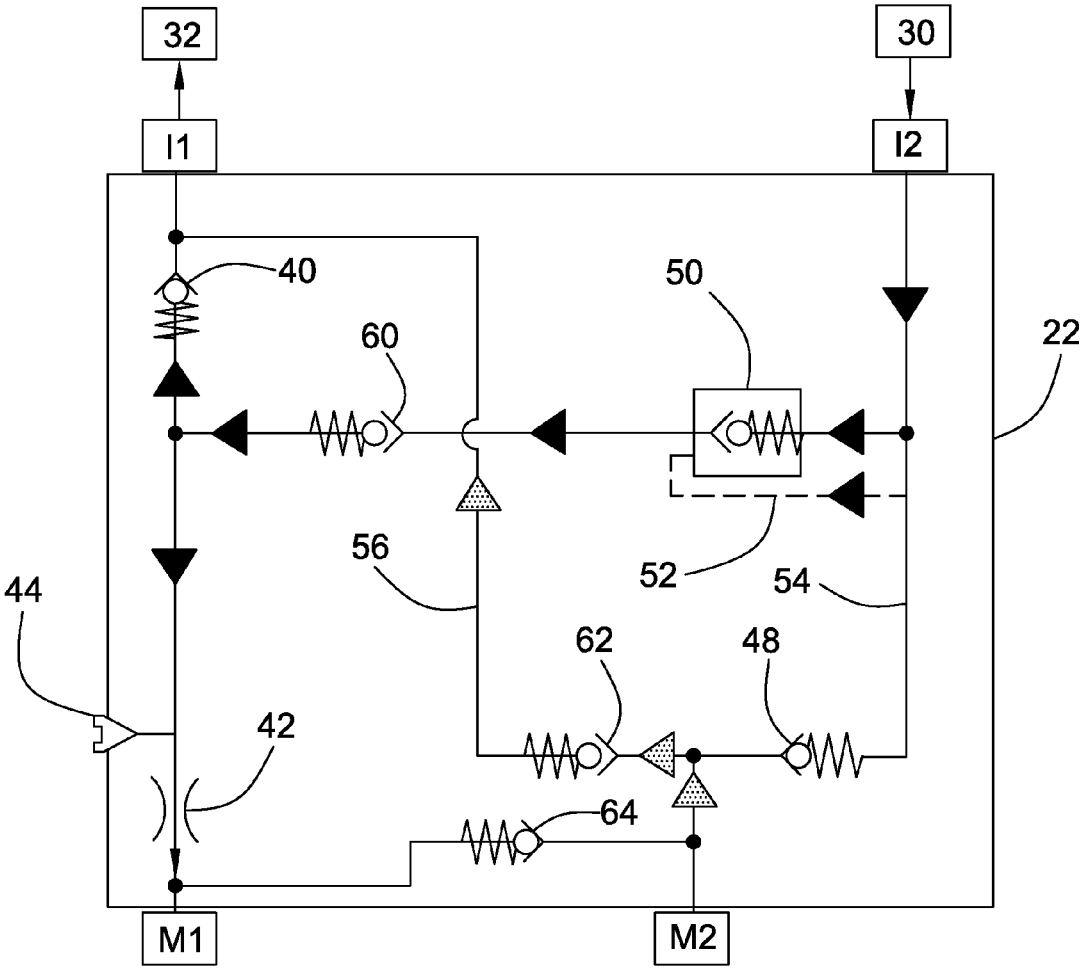
FIG. 3 is a diagram of the flow control manifold of FIG. 2 connected to the work machine according to a second flow path configuration.

FIGS. 2 and 3 show one embodiment of a fluid circuit diagram for flow control manifold 22. FIGS. 2 and 3 share the same components and layout. However, the states of the components and the direction of flow-through of fluid depend upon which of the two manifold connections I1 and I2 connects to the hydraulic supply line 30. Flow control manifold 22 permits fluid connections I1 and I2 to attach in either of the two alternative arrangements shown in FIGS. 2 and 3 and operates in either configuration to supply pressurized fluid to M1, which represents the fluid input for tool 28. In other words, regardless of which of the fluid connections I1 and I2 is connected to either a source of pressurized fluid from the pump on the machine, or the return line, the presence of pressurized fluid to the work tool will be automatically adjusted through the flow control manifold 22 without manipulation by the tool installer or the machine operator.

Referring to FIG. 2, which illustrates a first connection configuration, flow control manifold 22 includes a first fluid manifold connection I1, which when connected to hydraulic supply line 30 receives pressurized hydraulic fluid from a fluid pump or a fluid supply of work machine 20. The flow control manifold 22 includes a second fluid manifold connection I2, which when connected to hydraulic return line 32 returns hydraulic fluid to, for example, a fluid tank or reservoir (not shown) of the work machine 20. Returning hydraulic fluid may be referred to as drain fluid.

FIG. 2 illustrates a first configuration or first flow path 38, 46 of the flow control manifold 22 through the manifold indicated by arrows. The first flow path 38, 46 includes a first passage 38 that begins at first fluid manifold connection I1 and extends to input M1. The first flow path 38, 46 includes a second passage 46 that begins at outlet M2 and extends to second fluid manifold connection I2.

Fluid pressure from I1 provided by supply line 30 enters the manifold 22 and is directed through the first passage 38. The first passage 38 may include a first check valve 40 that is opened by the fluid pressure from I1. The first passage 38 includes an optional standard orifice 42 downstream from the first check valve 40. Fluid passes through the standard orifice 42 and enters the tool 28 at input M1, which may be at a standardized pressure through operation of the standard orifice. The first passage 38 may also include a pressure relief valve 44 between the first check valve 40 and the standard orifice 42. The solid arrows of first passage 38 represent pressurized hydraulic fluid.

Fluid from the tool 28 exits the tool via outlet M2 and passes through the second passage 46 to return to the machine 20 by exiting at second fluid manifold connection I2. The non-solid arrows of second passage 46 represent lower hydraulic fluid pressure relative to the hydraulic fluid pressure of first passage 38. The second passage 46 may include a second check valve 48 that opens in response to return fluid flow in the second passage 46 from M2. The first flow path therefore includes flow through the first and second passages 38, 46 in the direction indicated by respective solid and non-solid arrows.

In addition, fluid flow in second passage 46 is in communication with a directional control valve 50, which may be in the form of a pilot to open or pilot operated check valve and pilot port 52. In the configuration shown, where the second passage 46 receives return fluid flow, which is at a relatively lower fluid pressure than fluid in the first passage 38, the fluid pressure in the pilot port 52 is insufficient to open the directional control valve 50 and represents a first position of the directional control valve which position is maintained by the relatively low fluid pressure. Accordingly, the directional control valve 50 remains closed in the first configuration of the flow control manifold 22 with first flow path 38, 46 and return fluid passes through the flow control manifold 22 and into the work machine 20 via second fluid manifold connection I2.

FIG. 3 illustrates a second configuration or second flow path 54, 56 of the flow control manifold 22 in a direction through the manifold indicated by arrows. The second flow path 54, 56 includes a third passage 54 and a fourth passage 56. The third passage 54 begins at second fluid manifold connection I2 and enters the input M1 of tool 28. The fourth passage 56 begins at outlet M2 and ends at first fluid manifold connection I1.

Fluid pressure from I2 provided by supply line 30 enters the manifold 22 and is directed through the third passage 54. The third passage 54 includes second check valve 48 that is closed by the fluid pressure from second fluid manifold connection I2. With second check valve 48 closed, fluid pressure in the third passage 54 represented by the solid arrows, is directed into the directional control valve 50 and pilot port 52, which is configured to open the directional control valve overcoming the spring bias of the directional control valve, which represents a second position of the directional control valve.

It will be understood that while fluid pressure is involved in one embodiment of operating (opening and closing) the directional control valve 50, other mechanisms (not shown) may be employed to switch the state of the directional control valve. For example, a pressure sensor and solenoid in communication with a controller may be employed to change the state of the directional control valve 50 in response to sensed changes in fluid pressure corresponding to different connections to the work machine 20. Directional control valves are known that are operated manually, by solenoid, and other mechanisms.

After passing through directional control valve 50, fluid pressure opens a third check valve 60. Fluid in the third passage 54 passes through optional standard orifice 42 downstream from the third check valve 60 and enters the tool 28 (FIG. 1) at input M1 at a standardized pressure through operation of the standard orifice 42. The third passage 54 may also include the pressure relief valve 44 between the third check valve 60 and standard orifice 42. The third passage 54 directs flow to the input M1 at least in part to the first check valve 40 closing and preventing the fluid from exiting at first fluid manifold connection I1.

Fluid from the tool 28 exits the work tool via outlet M2 and passes through the fourth passage 56 to return to the machine 20 by exiting the flow control manifold 22 at first fluid manifold connection I1. The non-solid arrows of fourth passage 56 represent lower hydraulic fluid pressure relative to the pressure of third passage 54. The fourth passage 56 may include a fourth check valve 62 that opens in response to return fluid flow from outlet M2. The second flow path therefore includes third and fourth passages 54, 56 in which fluid flows when the pilot operated check valve of the directional control valve 50 is caused to be open, directing fluid to the tool input M1 and reversing flow through of flow control manifold 22. An optional tool check valve 64 connects the input M1 to the outlet M2 and opens if the hydraulic fluid pressure is higher at outlet M2 than at input M1.

Figure 4:
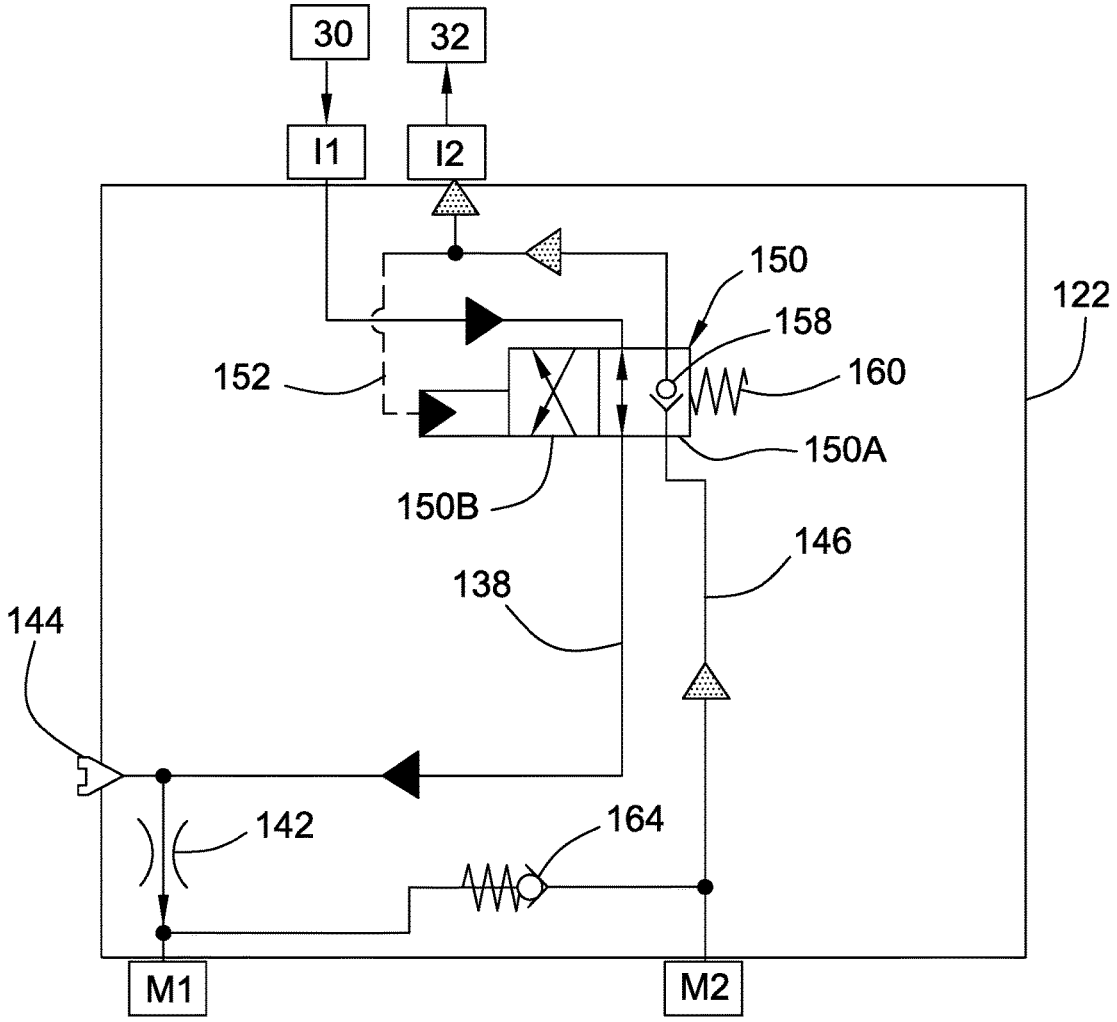
FIG. 4 is a diagram of another embodiment of a flow control manifold connected to the work machine according to a first flow path configuration.
Figure 5:
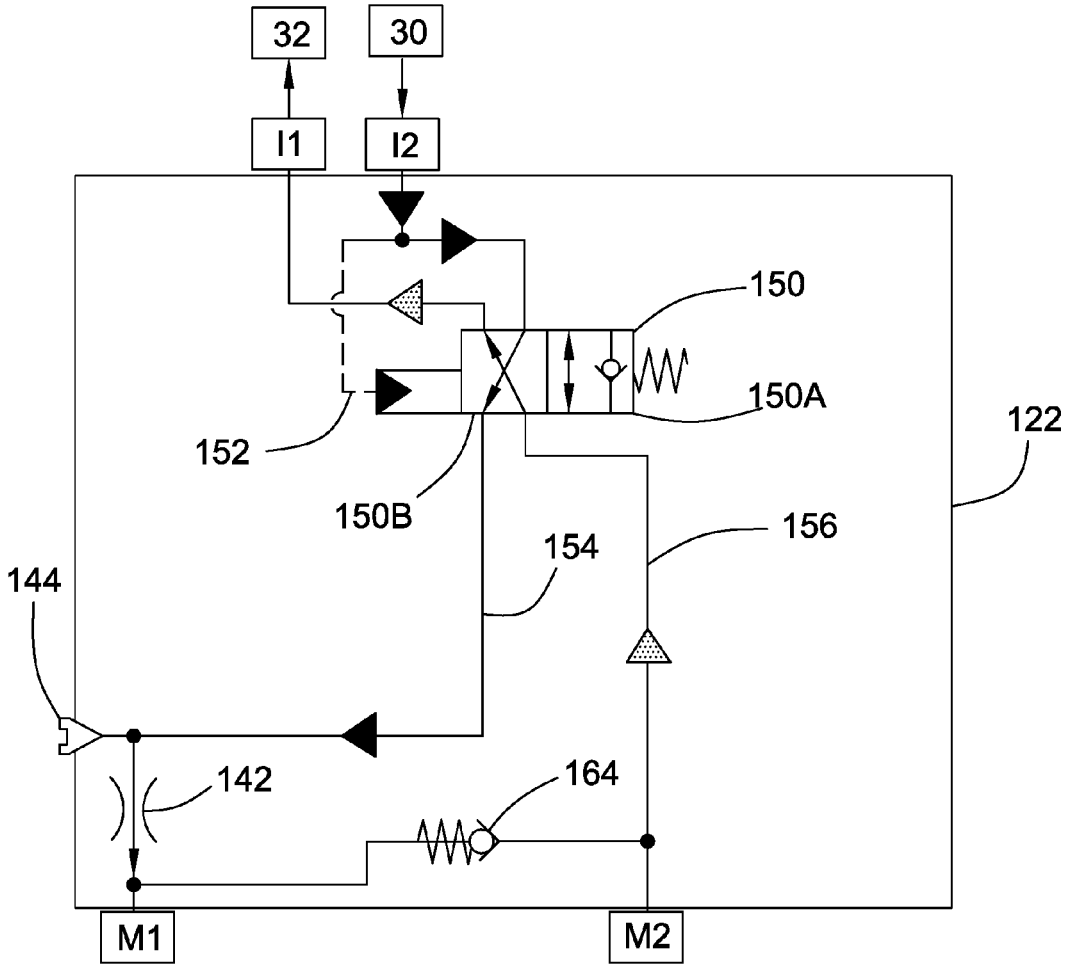
FIG. 5 is a diagram of the flow control manifold of FIG. 4 connected to the work machine according to a second flow path configuration.

The embodiment of FIGS. 4 and 5 provides a flow control manifold 122 that responds to different fluid pressure in the first and second manifold connections I1 and I2. The flow control manifold 122 in a first state of connection includes fluid flow through a first flow path 138, 146 and, in a second state of connection includes fluid flow through a second flow path 154, 156.

Flow of fluid through the first and second flow passages 138, 146 defining a first flow path is determined by the state of a directional control valve 150, the two states respectively shown in FIGS. 4 and 5, which may be in the form of a 4-way, 2-position hydraulic pilot-operated valve. The directional control valve 150 may be responsive to fluid pressure and operates to route the higher fluid pressure to input M1 regardless of which of fluid connection I1 or I2 is connected to the work machine 20 (FIG. 1). The state of the directional control valve 150 may also be controlled by manual or automatic mechanisms as is known. The directional control valve 150 includes a first section 150A that includes a straight through configuration and a second section 150B that includes a crossover configuration.

FIG. 4 shows flow control manifold 122 with the first fluid manifold connection I1 connected to hydraulic supply line 30. The second fluid manifold connection I2 is connected to hydraulic return line 32. Pressurized fluid, indicated with solid arrows, flows through the flow control manifold 122 through a first passage 138. Return or drain fluid, indicated with non-solid arrows, flows through the flow control manifold 122 through a second passage 146.

The first passage 138 includes fluid flow through the directional control valve 150. Fluid flow through the directional control valve 150 occurs through the first section 150A, which includes a non-crossover or straight through configuration. Fluid flow exits the directional control valve 150, passes through an optional standard orifice 142, and enters the work tool (FIG. 1) at input M1. After passing through and operating the work tool 28 (FIG. 1) relatively lower pressure fluid exits the work tool at outlet M2 to enter and pass through the second passage 146. The first passage 138 may also include a pressure relief valve 144 upstream of the standard orifice 142.

The second passage 146 includes fluid flow through first section 150A of the directional control valve 150 in the direction opposite the first passage 138. The part of the second passage 146 that passes through first section 150A of the directional control valve 150 may include a first check valve 158 that opens in the direction of fluid flow from outlet M2 to connection I2. The fluid pressure in the second passage 146 is shared with pilot port 152 of the directional control valve 150. In the illustrated state, the fluid pressure in pilot port 152 is insufficient to shift the directional control valve 150, which is biased in the state shown in FIG. 4 by biasing member 160, which may be a coil spring. An optional tool check valve 164 connects the input M1 to the outlet M2 and opens if the hydraulic fluid pressure is higher at outlet M2 than at input M1.

FIG. 5 shows flow control manifold 122 with the first fluid manifold connection I1 connected to hydraulic return line 32. The second fluid manifold connection I2 is connected to hydraulic supply line 30. Pressurized fluid, indicated with solid arrows, flows through the flow control manifold 122 along a third passage 154. Return or drain fluid, indicated with non-solid arrows, flows through the flow control manifold 122 along a fourth passage 156.

The third passage 154 includes fluid flow from second fluid manifold connection I2 through the directional control valve 150. Fluid flow through the directional control valve 150 occurs through the second section 150B, which includes a crossover configuration. Fluid pressure from hydraulic supply line 30 entering the second manifold connection I2 of flow control manifold 122 also pressurizes the pilot port 152 causing the shifting of the directional control valve 150 so as to bring the second section 150B thereof into communication with the passages of the flow control manifold 122 and creating the second flow path 154, 156. Passing through the second section 150B has the effect of reversing the direction of flow relative to the first flow path 138/146 (FIG. 4) in the passages of the flow control manifold 122.

Fluid flow exits the directional control valve second section 150B and passes through an optional standard orifice 142. Pressurized fluid enters the work tool 28 (FIG. 1) at input M1. After passing through and operating the work tool 28 (FIG. 1), relatively lower pressure or drain fluid exits the work tool at outlet M2 to pass through the fourth passage 156. The fourth passage 156 includes fluid flow through second section 150B of the directional control valve 150. Drain fluid is directed from the directional control valve 150 to the first fluid manifold connection I1 and hydraulic return line 32.

Figure 6:
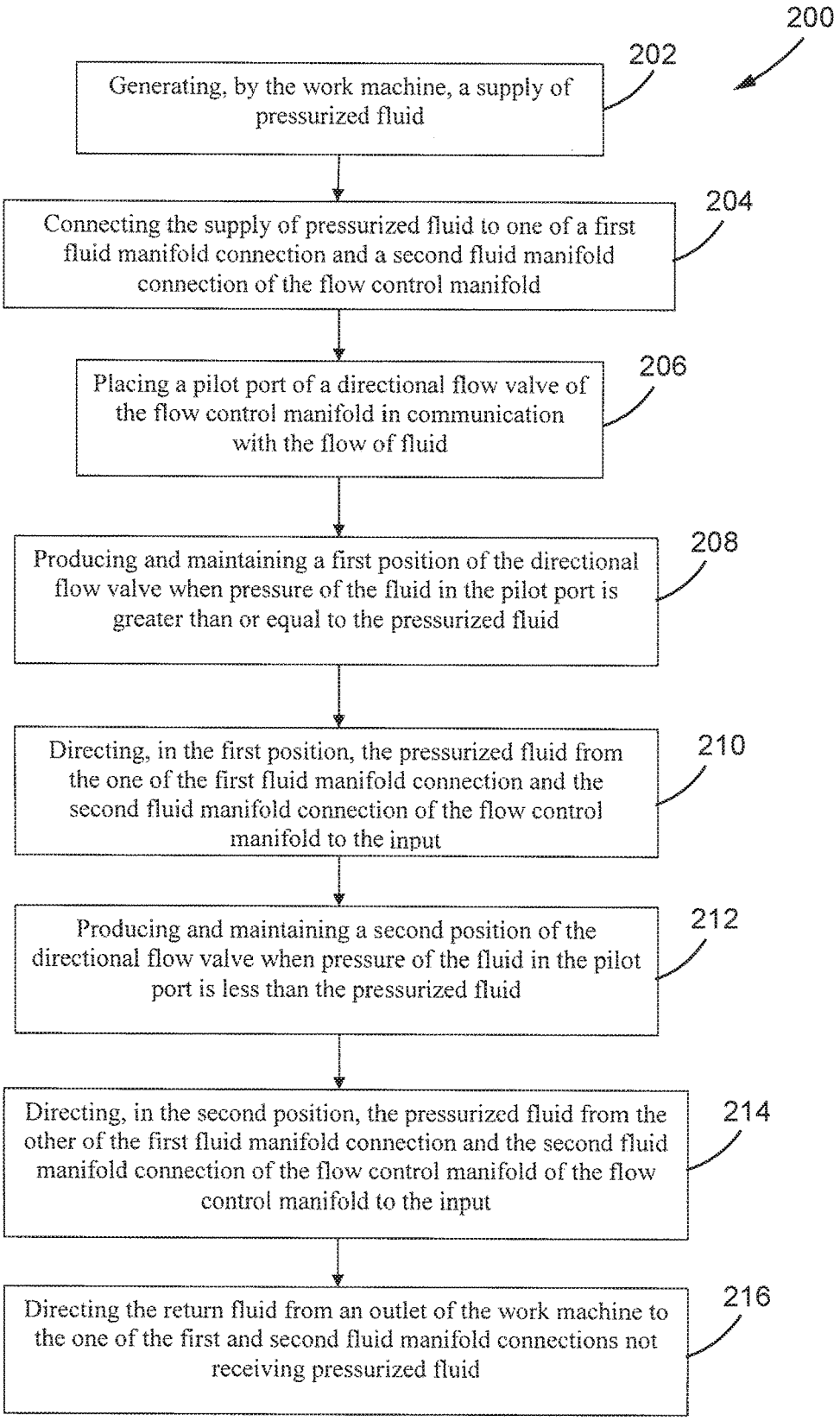
FIG. 6 is a method of method of directing a flow of fluid through a flow control manifold to a work tool from a work machine.

In FIG. 6 the disclosure describes a method 200 of directing a flow of fluid including a supply of pressurized fluid from a work machine to an input of a work tool and returning the flow of fluid including return fluid to the work machine from an outlet of the work tool through a flow control manifold, including generating, by the work machine, a supply of pressurized fluid 202. The supply of pressurized fluid is connected to one of a first fluid manifold connection and a second fluid manifold connection of the flow control manifold 204. A pilot port of a directional flow valve of the flow control manifold is placed in communication with the flow of fluid 206. A first position of the directional flow valve is produced and maintained when pressure of the fluid in the pilot port is greater than or equal to the pressurized fluid 208. In the first position, the pressurized fluid is directed from the one of the first fluid manifold connection and the second fluid manifold connection of the flow control manifold to the input 210. A second position of the directional flow valve is produced and maintained when pressure of the fluid in the pilot port is less than the pressurized fluid 212. In the second position, the pressurized fluid is directed from the other of the first fluid manifold connection and the second fluid manifold connection of the flow control manifold to the input 214 and the return fluid is directed from an outlet of the work machine to the one of the first and second fluid manifold connections not receiving pressurized fluid 216.

INDUSTRIAL APPLICABILITY

The present disclosure is applicable to any work machine that may be used with one or more different work tools and provides manifolds that selectively route hydraulic fluid to and from the work tool in a direction that operates the work tool regardless of how the manifold is attached to hydraulic fluid connections of the work machine.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

I claim:

1. A flow control manifold for connecting a work tool to a work machine, comprising:

a first fluid manifold connection and a second fluid manifold connection, the first and second fluid manifold connections in fluid communication with the work machine;

an input configured to supply pressurized fluid from the work machine to the work tool and an outlet configured to receive return fluid from the work tool;

a first passage fluidly connecting the first fluid manifold connection to the input and conveying pressurized fluid therethrough, the first passage comprising a first check valve that opens in a direction of the input;

a second passage fluidly connecting the outlet to the second fluid manifold connection and conveying return fluid therethrough, the second passage comprising a second check valve that opens in a direction of the second fluid manifold connection;

a third passage fluidly connecting the second fluid manifold connection to the input and conveying pressurized fluid therethrough, the third passage comprising a directional control valve that opens to permit fluid to flow through the third passage in response to the presence of the pressurized fluid in the third passage and comprising a third check valve that opens in the direction of the input; and a fourth passage fluidly connecting the outlet to the first fluid manifold connection and conveying return fluid therethrough, the fourth passage comprising a fourth check valve that opens in a direction of the first fluid manifold connection.

2. The flow control manifold of claim 1, wherein the first and third passages include a standard orifice adjacent the input.

3. The flow control manifold of claim 1, wherein the first and third passages include a pressure relief valve.

4. The flow control manifold of claim 1, further comprising a pressure relief check valve disposed between the input and the outlet and opening in response to a condition wherein fluid pressure is greater at the outlet than at the input.

5. The flow control manifold of claim 1, wherein the directional control valve is a pilot operated check valve.

6. The flow control manifold of claim 5, wherein the directional control valve is biased in a closed state in the direction of the input.

7. The flow control manifold of claim 5, wherein the directional control valve is in fluid communication with the second passage and is biased in a closed state.

8. The flow control manifold of claim 7, wherein the return fluid in the second passage is of an insufficient pressure to open the directional control valve.

9. The flow control manifold of claim 1, wherein the first and second passages define a first flow path between the work machine and the work tool through the flow control manifold and the third and fourth passages define a second flow path between the work machine and the work tool through the flow control manifold, the first and second flow paths having different directions of fluid flow, and wherein one of the first and second flow paths is selected by the directional control valve.

10. A work machine, comprising;

a work tool;

a source of fluid pressure to operate the work tool;

a fluid reservoir to store return fluid from the work tool; and a flow control manifold for fluidly connecting the work tool to the work machine, the flow control manifold comprising:

a first fluid manifold connection and a second fluid manifold connection, the first and second fluid manifold connections in fluid communication with the work machine;

an input configured to supply pressurized fluid from the work machine to the work tool and an outlet configured to receive return fluid from the work tool;

a directional control valve comprising a four-way, two-position valve including a first section and a second section, and a pilot port, the pilot port in fluid communication with the second fluid manifold connection, the directional control valve assuming a first position of the two positions wherein the first section routes fluid pressure from the first fluid manifold connection to the input and routes return fluid from the outlet to the second fluid manifold connection when fluid pressure at the pilot port is relatively lower than at the first fluid manifold connection and the directional control valve assuming a second position of the two positions wherein the second section routes fluid pressure from the second fluid manifold connection to the input and routes return fluid from the outlet to the first fluid manifold connection when fluid pressure at the pilot port is relatively higher than at the first fluid manifold connection.

11. The work machine of claim 10, wherein the flow control manifold is biased in the first position.

12. The work machine of claim 10, further including a standard orifice between the directional control valve and the input.

13. The work machine of claim 10, further including a pressure relief valve between the directional control valve and the input.

14. The work machine of claim 10, further including a check valve in the first section between the outlet and the second fluid manifold connection.

15. A method of directing a flow of fluid including a supply of pressurized fluid from a work machine to an input of a work tool and returning the flow of fluid including return fluid to the work machine from an outlet of the work tool through a flow control manifold, comprising:

generating, by the work machine, a supply of pressurized fluid;

connecting the supply of pressurized fluid to one of a first fluid manifold connection and a second fluid manifold connection of the flow control manifold;

placing a pilot port of a directional flow valve of the flow control manifold in communication with the flow of fluid;

producing and maintaining a first position of the directional flow valve when pressure of the fluid in the pilot port is greater than or equal to the pressurized fluid;

directing, in the first position, the pressurized fluid from the one of the first fluid manifold connection and the second fluid manifold connection of the flow control manifold to the input;

producing and maintaining a second position of the directional flow valve when pressure of the fluid in the pilot port is less than the pressurized fluid;

directing, in the second position, the pressurized fluid from the other of the first fluid manifold connection and the second fluid manifold connection of the flow control manifold to the input; and directing the return fluid from an outlet of the work machine to the one of the first and second fluid manifold connections not receiving pressurized fluid.

16. The method of claim 15, wherein the directional flow valve is biased in the second position.

17. The method of claim 15, wherein the pressure of the fluid in the pilot port opens a check valve portion of the directional flow valve to produce the first position.

18. The method of claim 15, wherein the pressure of the fluid in the pilot port shifts the directional control valve from a first section to a second section.

19. The method of claim 15, wherein the directional control valve is a pilot operated check valve.

20. The method of claim 15, wherein the directional control valve is a four-way, two-position control valve.

* * * * *